US005351413A

United States Patent [19]

Bruner et al.

[11] Patent Number: 5,351,413

[45] Date of Patent: Oct. 4, 1994

[54] CLEARANCE CHECKING TOOL

[76] Inventors: C. W. Bruner; Ingrid E. Bruner, both of 2040 Brannon Dr., Austell, Ga. 30001

[21] Appl. No.: 61,261

[22] Filed: May 17, 1993

[51] Int. Cl.[5] ..... G01D 21/00

[52] U.S. Cl. ..... 33/611; 33/600; 7/100; 73/119 R

[58] Field of Search ..... 33/600, 603, 604, 605, 33/607, 611; 73/161, 119 R; 81/3.55, 3.57; 7/100, 166, 170

[56] References Cited

U.S. PATENT DOCUMENTS

| | | | |
|---|---|---|---|
| 1,314,012 | 8/1919 | Mowers | 7/100 |
| 1,582,442 | 4/1926 | White | 81/3.57 |
| 2,514,566 | 7/1950 | Capriccio | 81/3.57 |
| 2,624,489 | 1/1953 | Wishart | 81/3.57 |
| 2,835,044 | 5/1958 | Haunert | 33/611 |
| 3,640,129 | 2/1972 | Bandimere | 73/119 R |
| 3,988,925 | 11/1976 | Seccombe et al. | 33/611 |
| 4,186,594 | 2/1980 | Mitchell | 73/161 |
| 4,572,040 | 2/1986 | Metz | 7/100 |

FOREIGN PATENT DOCUMENTS

| | | | |
|---|---|---|---|
| 0241698 | 4/1969 | U.S.S.R. | 33/611 |

*Primary Examiner*—Thomas B. Will

*Attorney, Agent, or Firm*—E. Michael Combs

[57] ABSTRACT

A tool arranged to receive a rocker arm of an internal combustion engine to direct the rocker arm to displace a valve and thereby permit measuring of such linear displacement is provided. The tool is arranged to include a first wall mounting a handle, and a second wall having a rocker arm receiving surface to effect rotation of the rocker arm about its fulcrum, with an abutment rod arranged to engage the valve assembly in its displacement.

2 Claims, 4 Drawing Sheets

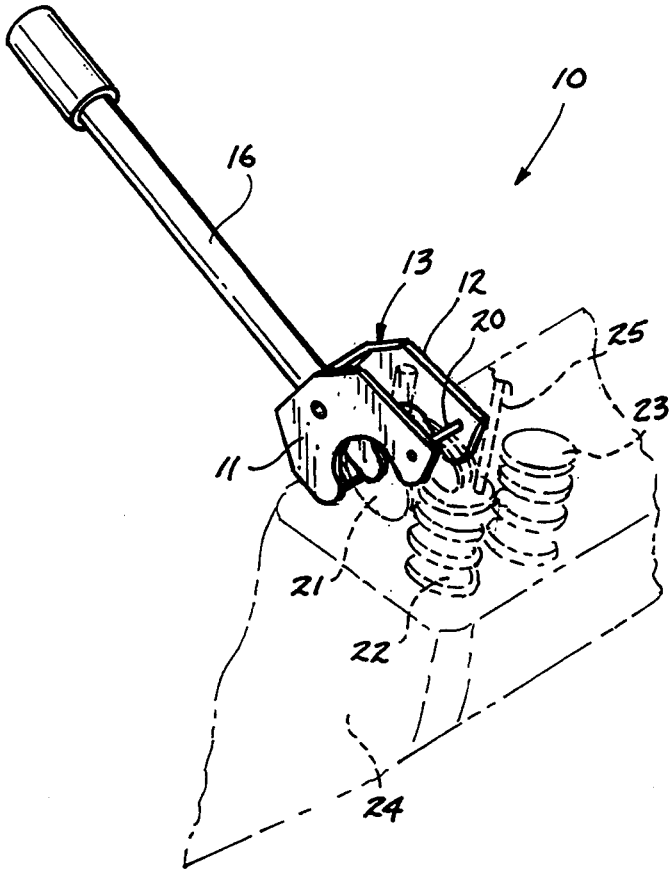
FIG. 1
FIG. 2
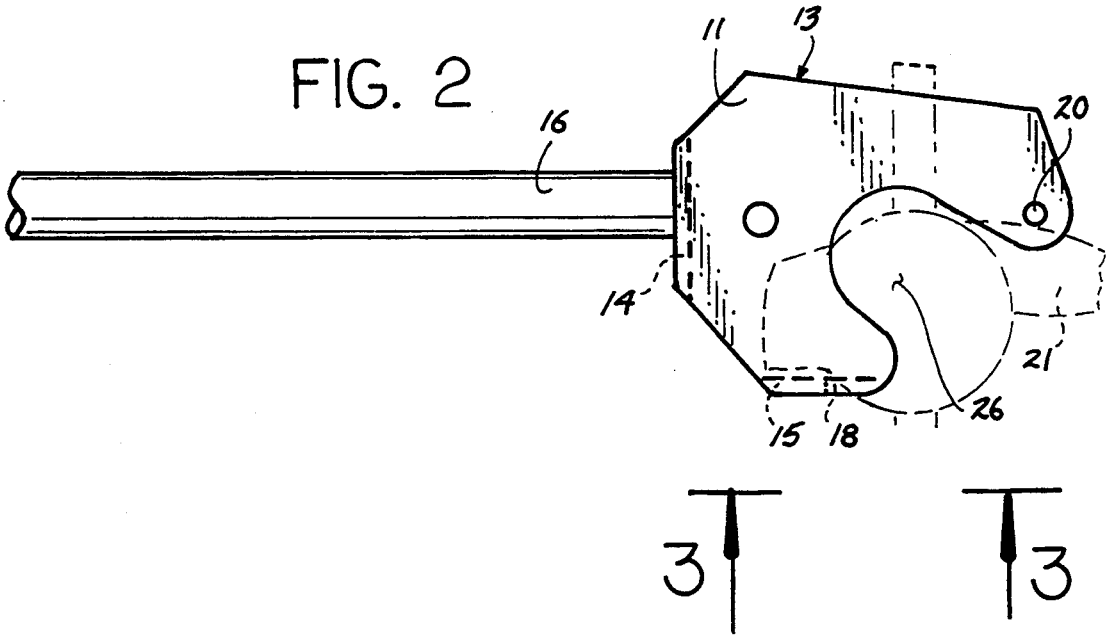

FIG. 5
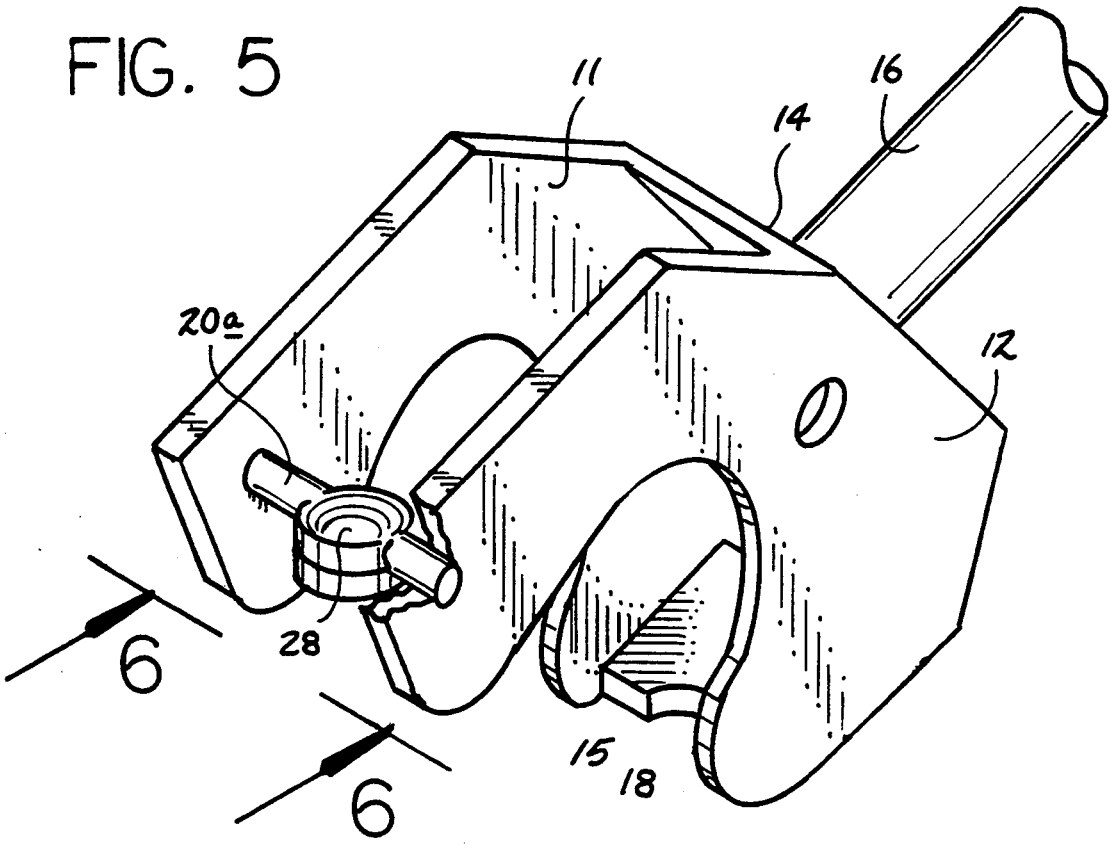
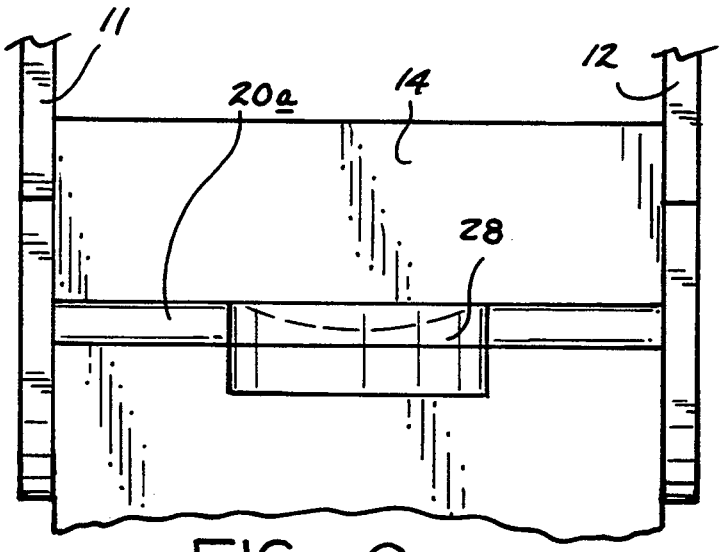
FIG. 6

CLEARANCE CHECKING TOOL

BACKGROUND OF THE INVENTION

1. Field of the Invention

The field of invention relates to measuring tool structure, and more particularly pertains to a new and improved clearance checking tool wherein the same is directed to the measuring of displacement relative to a valve and its clearance with an associated piston.

2. Description of the Prior Art

Tool structure of various types has been indicated in the prior art relative to an internal combustion engine construction, such as U.S. Pat. No. 4,389,882 indicating a measuring device connected to a valve retainer. Valve clearance checking is indicated in U.S. Pat. Nos. 4,483,185 and 4,370,884, with U.S. Pat. No. 4,453,402 indicating the orientation of a piston within an internal combustion engine.

The instant invention is directed to overcome deficiencies of the prior art. Typically in a piston to valve clearance check to provide indication of adequate clearance relative to a valve directed towards a piston dome in a top head center situation, clay or other such malleable material is positioned on a piston dome whereupon subsequently to the cycling of the piston engine, deformation of such clay and the like is measured having been compressed when an associated valve member is directed towards the piston dome. The instant invention attempts to overcome such deficiencies of the prior art whereupon an individual merely employs the existing rocker arm structure and displaces the rocker arm structure relative to the valve and valve travel is measured from a seated position to an abutting position relative to an associated internal combustion engine and in this manner, linear available travel of the valve is availed without undue engine disassembly and the like and in this respect, the present invention substantially fulfills this need.

SUMMARY OF THE INVENTION

In view of the foregoing disadvantages inherent in the known types of clearance checking tools now present in the prior art, the present invention provides a clearance checking tool wherein the same is directed to the pivoting of a rocker arm permitting associated displacement of a valve relative to a valve seat. As such, the general purpose of the present invention, which will be described subsequently in greater detail, is to provide a new and improved clearance checking tool which has all the advantages of the prior art clearance checking tools and none of the disadvantages.

To attain this, the present invention provides a tool arranged to receive a rocker arm of an internal combustion engine to direct the rocker arm to displace a valve and thereby permit measuring of such linear displacement. The tool is arranged to include a first wall mounting a handle, and a second wall having a rocker arm receiving surface to effect rotation of the rocker arm about its fulcrum, with an abutment rod arranged to engage the valve assembly in its displacement.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved clearance checking tool which has all the advantages of the prior art clearance checking tools and none of the disadvantages.

It is another object of the present invention to provide a new and improved clearance checking tool which may be easily and efficiently manufactured and marketed.

It is a further object of the present invention to provide a new and improved clearance checking tool which is of a durable and reliable construction.

An even further object of the present invention is to provide a new and improved clearance checking tool which is susceptible of a low cost of manufacture with regard to both materials and labor, and which accordingly is then susceptible of low prices of sale to the consuming public, thereby making such clearance checking tools economically available to the buying public.

Still yet another object of the present invention is to provide a new and improved clearance checking tool which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is an isometric illustration of the invention in use.

FIG. 2 is an orthographic side view of the invention.

FIG. 5 is an isometric illustration of the invention employing a measuring cup member.

FIG. 6 is an orthographic view, taken along the lines 6—6 of FIG. 5 in the direction indicated by the arrows.

DESCRIPTION OF THE PREFERRED EMBODIMENT

Figure 3:
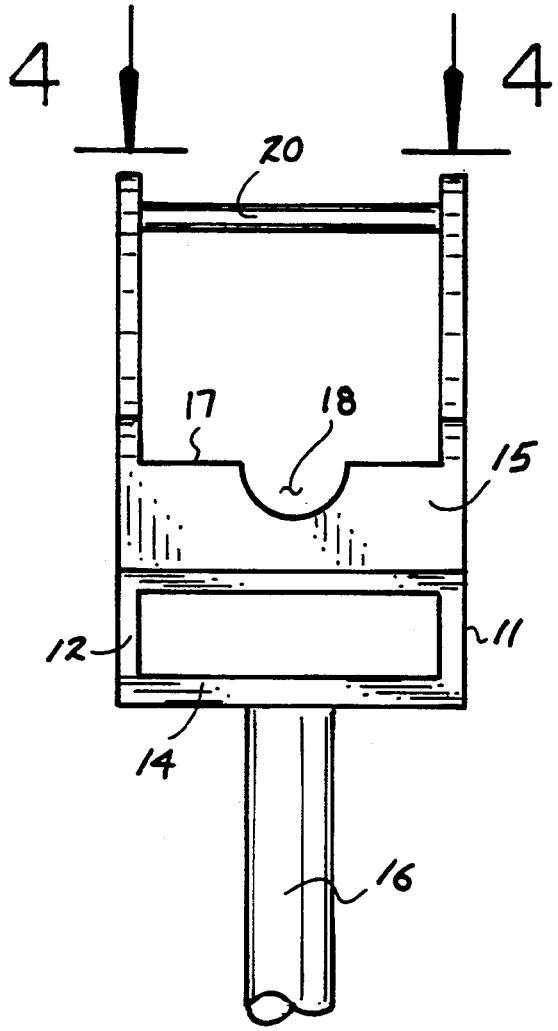
FIG. 3 is an orthographic view, taken along the lines 3—3 of FIG. 2 in the direction indicated by the arrows.
Figure 4:
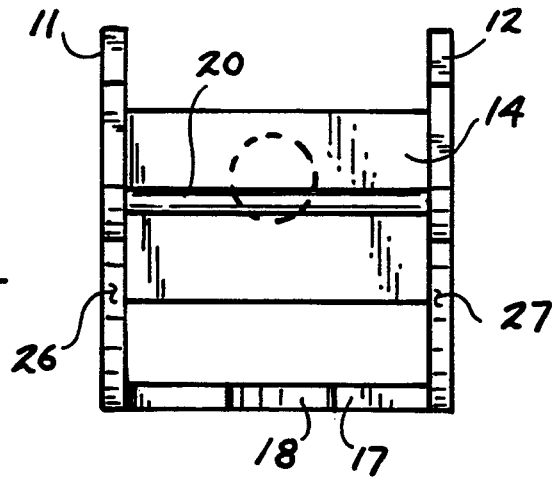
FIG. 4 is an orthographic view, taken along the lines 4–4 of FIG. 3 in the direction indicated by the arrows.

With reference now to the drawings, and in particular to FIGS. 1 to 8 thereof, a new and improved clearance checking tool embodying the principles and concepts of the present invention and generally designated by the reference numeral 10 will be described.

More specifically, the clearance checking tool 10 of the instant invention essentially comprises an engaging head 13 having respective first and second plates 11 and 12 arranged in a spaced, parallel, and coextensive relationship relative to one another, with a first wall 14 orthogonally oriented between the first and second plates 11 and 12 at a first end of the engaging head 13. The first wall 14 having a handle 16 mounted to the first wall. A second wall 15 is orthogonally oriented between the first and second plates arranged in an orientation obliquely oriented relative to the first wall 14 such that the second wall is mounted between the first and second plates at a lowermost end of the engaging head 13 in spaced adjacency to the first wall 14. A second wall 15 is provided with a forward end 17 in a facing relationship relative to a second end of the engaging head, such that the second wall forward end 17 includes a second wall recess 18 medially of the forward end 17 to receive a push rod member (not shown) and provide for proper orientation of the engaging head and alignment of the engaging head relative to the positioning of the rocker arm 21 between the first and second plates 11 and 12 onto the second wall 15, as indicated in FIG. 2. An abutment rod 20 is positioned above the rocker arm in a parallel relationship relative to the second wall 15 at the second end of the engaging head 13 between the lowermost and uppermost ends of the engaging head to effect abutment of the top surface of the rocker arm to permit displacement of the rocker arm relative to the associated valve spring 22 such that the valve spring retainer 23 is permitted to receive a dial indicator rod 25 to measure the linear displacement of the retainer 23 and the associated valve structure as is known in the prior art secured within the valve spring retainer 23 of the associated engine head assembly 24. Relative alignment of the valve spring, valve spring retainer, and valve relative to the engine assembly head is indicated in U.S. Pat. No. 4,389,882 incorporated herein by reference.

FIG. 5 and FIG. 6 indicates the use of a modified abutment rod 20*a* having a cup member 28 mounted medially thereof, with the modified abutment rod 20*a* arranged for rotation within the engaging head 13. In this manner, the cup member 28 having a concave cavity may receive the dial indicator rod 25 in a more secure non-slip relationship if desired.

Figure 7:
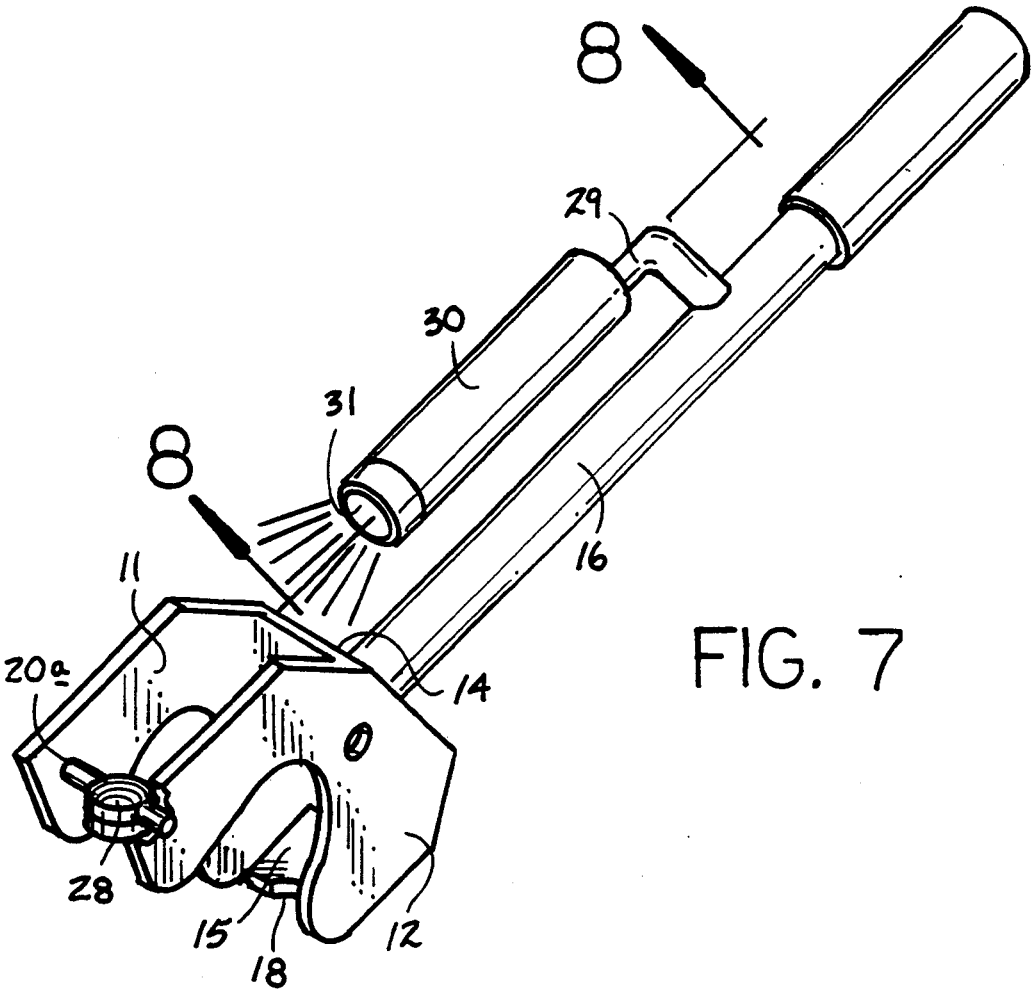
FIG. 7 is an isometric illustration of a modified aspect of the invention.
Figure 8:
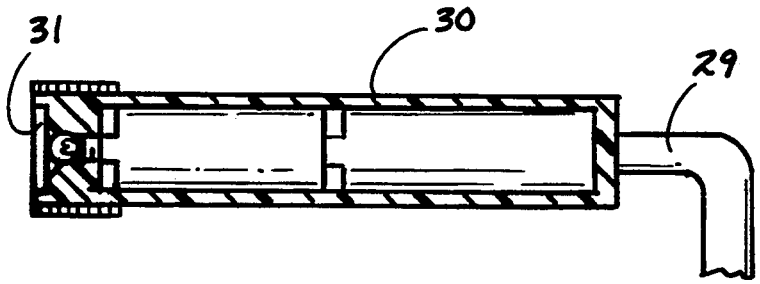
FIG. 8 is an orthographic view, taken along the lines 8—8 of FIG. 7 in the direction indicated by the arrows.

Further, the FIGS. 7 and 8 indicates the use of a flashlight rod 29 fixedly mounted to the handle 16 mounting a flashlight body 30 in a parallel relationship relative to the flashlight rod 29, such that the flashlight body 30 is arranged in a coaxially aligned relationship having a flashlight lens 31, such that the flashlight body 30 is aligned between the first and second plates 11 and 12 beyond the first wall 14 to direct illumination upon the cup member 28 to maintain proper and available visual observation of the dial indicator rod mounted within the cup member 28 in use.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A clearance checking tool, comprising, an engaging head, the engaging head including a first plate arranged in a parallel, spaced, and coextensive relationship relative to a second plate, and the engaging head including a first end spaced from a second end, a lowermost end spaced from an uppermost end, with a first wall directed between the first plate and the second plate at the first end, and a handle mounted to the first wall, a second wall obliquely oriented relative to the first wall and positioned in a spaced relationship relative to the first wall at the lowermost end in adjacency to the first end, and an abutment rod positioned near said second end extending in a parallel relationship relative to the second wall positioned between the second wall and the uppermost end of the engaging head, and the second wall includes a forward end, the forward end arranged in a facing relationship relative to the second end of the engaging head, the forward end including a second wall recess oriented medially of the forward end to receive a push rod therewithin to stabilize the engaging head when receiving a rocker arm within the engaging head associated with said push rod, and the abutment rod includes a cup member medially of the abutment rod having a concave recess, and the abutment rod is arranged for rotation between the first plate and the second plate.

2. A tool as set forth in claim 1 including a flashlight body, the flashlight body including a flashlight rod extending from the flashlight body fixedly mounting the flashlight body relative to the handle, with the flashlight body aligned between the first plate and the second plate spaced from the first wall, with the flashlight body spaced from the engaging head to direct illumination onto the engaging head between the first plate and the second plate.

* * * * *